US007520271B2

(12) United States Patent
Saito

(10) Patent No.: US 7,520,271 B2
(45) Date of Patent: Apr. 21, 2009

(54) EVAPORATED FUEL ADSORBING MECHANISM FOR INTERNAL COMBUSTION ENGINE

(75) Inventor: Haruhiko Saito, Toyota (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 0 days.

(21) Appl. No.: 11/790,204

(22) Filed: Apr. 24, 2007

(65) Prior Publication Data

US 2007/0246023 A1 Oct. 25, 2007

(30) Foreign Application Priority Data

Apr. 24, 2006 (JP) ..... 2006-119565

(51) Int. Cl.
*F02M 33/02* (2006.01)

(52) U.S. Cl. ..... 123/519; 123/518

(58) Field of Classification Search ..... 123/518, 123/519; 55/463, 331, 385.3, 529; 96/134
See application file for complete search history.

(56) References Cited

U.S. PATENT DOCUMENTS 3,762,564 A * 10/1973 Weedon et al. ..... 210/446
5,269,824 A * 12/1993 Takita ..... 55/493
5,800,581 A * 9/1998 Gielink et al. ..... 55/385.3
5,888,260 A * 3/1999 Sica ..... 55/331
6,132,483 A * 10/2000 Andrews ..... 55/385.1
6,383,268 B2 * 5/2002 Oda ..... 96/134
6,835,237 B2 * 12/2004 Ishida ..... 96/135
6,913,001 B2 * 7/2005 Abdolhosseini et al. ..... 123/519

FOREIGN PATENT DOCUMENTS

JP 2003-193917 7/2003

* cited by examiner

*Primary Examiner*—Stephen K Cronin
*Assistant Examiner*—J. Page Hufty
(74) *Attorney, Agent, or Firm*—Finnegan, Henderson, Farabow, Garrett & Dunner, LLP

(57) ABSTRACT

An evaporated fuel adsorbing mechanism for an internal combustion engine includes an adsorbing member provided in an intake passage of the internal combustion engine to adsorb evaporated fuel that flows back through the intake passage when the engine is stopped. The adsorbing member includes a connecting portion connected to an inner peripheral surface of the intake passage, an end portion that is away from the inner peripheral surface, and that is disposed downstream of the connecting portion in an intake-air flow direction in which intake air flows, and an upstream-side surface that faces toward an upstream side in the intake-air flow direction, and a downstream-side surface that faces toward a downstream side in the intake-air flow direction. The upstream-side surface and the downstream-side surface extend from the connecting portion to the end portion.

17 Claims, 4 Drawing Sheets

EVAPORATED FUEL ADSORBING MECHANISM FOR INTERNAL COMBUSTION ENGINE

INCORPORATION BY REFERENCE

The disclosure of Japanese Patent Application No. 2006-119565 filed on Apr. 24, 2006 including the specification, drawings and abstract is incorporated herein by reference in its entirety.

BACKGROUND OF THE INVENTION

1. Field of the Invention

The invention relates to an evaporated fuel adsorbing mechanism for an internal combustion engine, which adsorbs evaporated fuel that flows back through an intake passage when the engine is stopped.

2. Description of the Related Art

When an internal combustion engine is stopped, air containing hydrocarbon (hereinafter referred to as HC) may flow back through an intake passage due to evaporation of fuel remaining near an intake port and an injector of the engine. Further, depending on the state of a cylinder when the engine is stopped, unburned air-fuel mixture remaining in a combustion chamber may flow back through the intake passage. Discharge of air containing HC into the atmosphere contributes to air pollution. To address this, an evaporated fuel adsorbing mechanism that includes an adsorbing member is available. The adsorbing member is provided downstream of a filter of an air cleaner to adsorb evaporated fuel using activated carbon or the like. With this arrangement, air containing HC passes through the adsorbing member when the air flows back to the upstream side of the intake passage. Thus, evaporated fuel is adsorbed by the adsorbing member.

In such an evaporated fuel adsorbing mechanism, the thickness of the adsorbing member may be increased to improve the capability of adsorbing the evaporated fuel. However, because air is introduced through the adsorbing member when the engine is operated, if the thickness of the entire adsorbing member is uniformly increased, a pressure loss may be greatly increased when the engine is operated.

Japanese Patent Application Publication No. 2003-193917 (JP-A-2003-193917) describes an evaporated fuel adsorbing mechanism that includes an adsorbing member. The adsorbing member is provided across the entire cross-section of a flow passage in an air cleaner. The thickness of the adsorbing member varies according to the concentration distribution of evaporated fuel. With this structure, the capability of adsorbing the evaporated fuel is improved, while the increase in the pressure loss during engine operation is suppressed as compared to the case where the thickness of the entire adsorbing member is uniformly increased.

In the evaporated fuel adsorbing mechanism described in JP-A-2003-193917, the thickness of the adsorbing member varies according to the concentration distribution of evaporated fuel. However, the resistance against the flow of intake air when the intake air passes through the adsorbing member during engine operation is equal to the resistance against the backflow of air when the air passes through the adsorbing member during engine stop. Therefore, the improvement in the capability of adsorbing the evaporated fuel results in the increase in the pressure loss during engine operation. Thus, the evaporated fuel adsorbing mechanism needs to be improved to improve the capability of adsorbing the evaporated fuel while suppressing the pressure loss during engine operation.

SUMMARY OF THE INVENTION

An evaporated fuel adsorbing mechanism for an internal combustion engine according to a first aspect of the invention includes an adsorbing member that is provided in an intake passage of the internal combustion engine to adsorb evaporated fuel that flows back through the intake passage when the internal combustion engine is stopped. The adsorbing member includes a connecting portion connected to an inner peripheral surface of the intake passage; an end portion that is away from the inner peripheral surface, and that is disposed downstream of the connecting portion in an intake-air flow direction in which intake air flows; and an upstream-side surface that faces toward an upstream side in the intake-air flow direction, and a downstream-side surface that faces toward a downstream side in the intake-air flow direction. The upstream-side surface and the downstream-side surface extend from the connecting portion to the end portion.

According to the first aspect of the invention, intake air smoothly flows along the upstream-side surface of the adsorbing member, from the connecting portion to the end portion when the engine is operated.

The evaporated fuel, which flows from the downstream side to the upstream side in the intake-air flow direction when the engine is stopped, flows along the downstream-side surface of the adsorbing member from the end portion to the connecting portion, and is retained in an area near and downstream of the connecting portion in the intake-air flow direction. Further, it is possible to reduce the possibility that the evaporated fuel, which flows along the inner peripheral surface of the intake passage toward the upstream side in the intake-air flow direction, enters the adsorbing member through the end portion. As a result, it is possible to significantly suppress the increase in the pressure loss during engine operation, while appropriately suppressing the discharge of the evaporated fuel to the atmosphere.

An evaporated fuel adsorbing mechanism for an internal combustion engine according to a second aspect of the invention includes an adsorbing member that is provided in a housing of an air cleaner to adsorb evaporated fuel that flows back through an intake passage when an engine is stopped. The adsorbing member includes a connecting portion connected to an inner peripheral surface of the housing; an end portion that is away from the inner peripheral surface, and that is disposed downstream of the connecting portion in an intake-air flow direction in which intake air flows; and an upstream-side surface that faces toward an upstream side in the intake-air flow direction, and a downstream-side surface that faces toward a downstream side in the intake-air flow direction. The upstream-side surface and the downstream-side surface extend from the connecting portion to the end portion.

According to the second aspect of the invention, the housing of the air cleaner is used as an enlarged portion of the intake passage. That is, the cross-sectional area that is larger than cross-sectional areas of portions of the intake passage upstream and downstream of the enlarged portion. Therefore, there is no need to separately form an enlarged portion in the intake passage.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
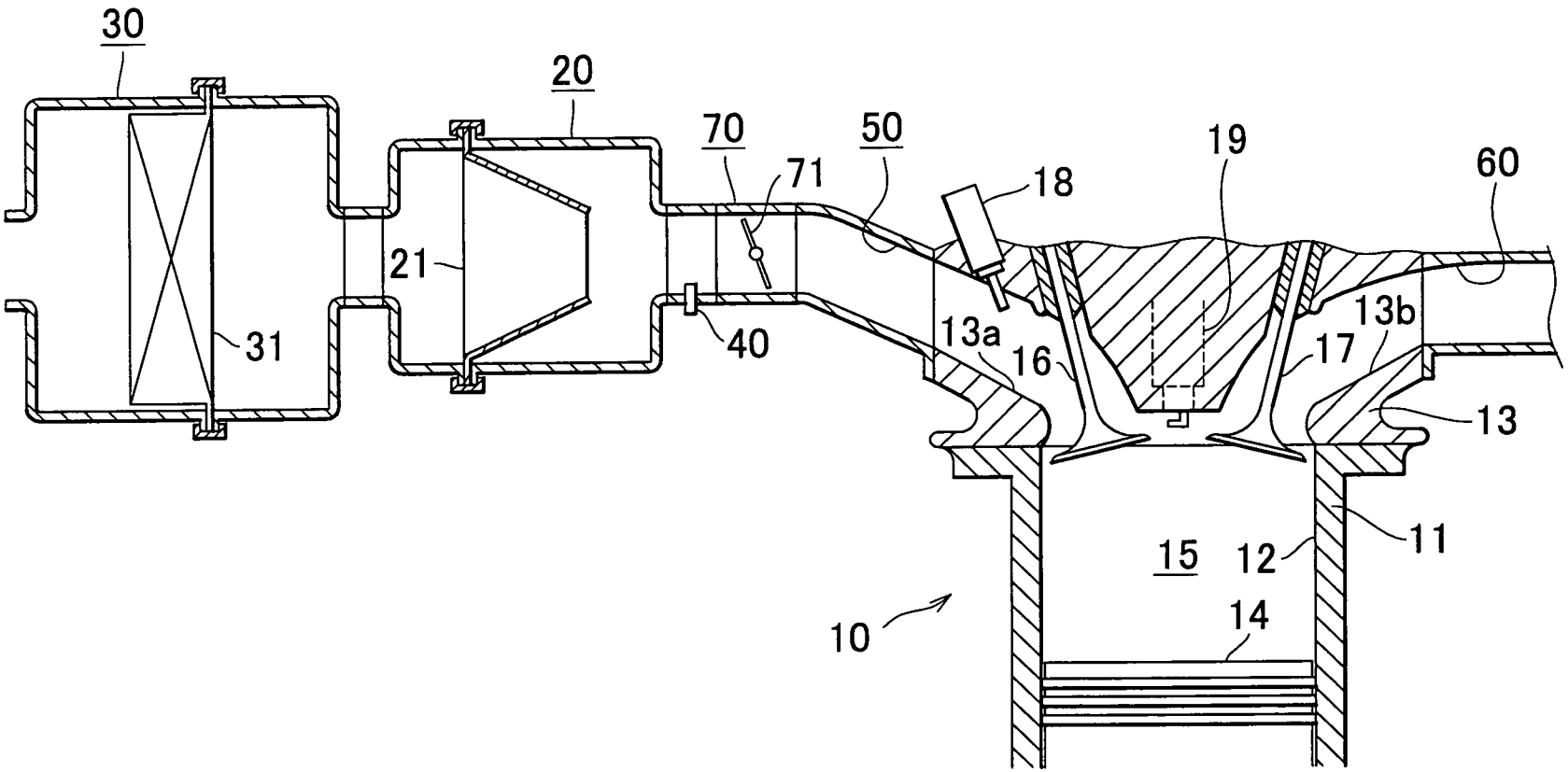
FIG. 1 is a schematic view showing the structure of an intake system according to a first embodiment of the invention.

Hereinafter, an evaporated fuel adsorbing mechanism for an internal combustion engine according to a first embodiment of the invention will be described, with reference to FIG. 1, FIG. 2 and FIG. 3. FIG. 1 shows the structure of an intake system according to a first embodiment of the invention in which an evaporated fuel adsorbing mechanism according to the invention is applied to an intake passage of an engine installed in a vehicle.

An engine 10 is an in-line four-cylinder engine in which four cylinders 12 (only one is shown in FIG. 1) are formed in a cylinder block 11. A cylinder head 13 is fitted to the upper portion of the cylinder block 11. A piston 14 is provided in each of the cylinders 12 such that the piston 14 moves upward and downward while contacting the inner surface of the cylinder 12. A combustion chamber 15 is formed in each of the cylinders 12 by a space defined by the wall surface of the cylinder 12, the top surface of the piston 14, and the bottom surface of the cylinder head 13.

The cylinder head 13 is provided with spark plugs 19 corresponding to the respective combustion chambers 15. Further, intake ports 13*a* and exhaust ports 13*b* that communicate with the combustion chambers 15 are formed in the cylinder head 13. Each of the intake ports 13*a* is connected to an intake passage 50, and each of the exhaust ports 13*b* is connected to an exhaust passage 60. The intake ports 13*a* and the intake passage 50 form an intake system, and the exhaust ports 13*b* and the exhaust passage 60 form an exhaust system.

Ends of the intake port 13*a* and the exhaust port 13*b* that communicate with the combustion chamber 15 are respectively provided with an intake valve 16 and an exhaust valve 17. The intake port 13*a* is opened/closed by the intake valve 16, and the exhaust port 13*b* is opened/closed by the exhaust valve 17. The intake valve 16 and the exhaust valve 17 are opened/closed, in synchronization with rotation of a crankshaft (not shown), by the operation of an intake cam and an exhaust cam that are drivingly connected to the crankshaft.

An inlet (the most upstream portion) of the intake passage 50 is provided with an air cleaner 30. The air cleaner 30 is provided with a filter 31 that collects dust in the air introduced into the engine 10. Thus, the air from which dust has been removed by the air cleaner 30 is introduced into the engine 10.

An evaporated fuel adsorbing mechanism 20 that includes an adsorbing member 21 is provided in a portion of the intake passage 50 downstream of the air cleaner 30. The adsorbing member 21 adsorbs evaporated fuel that flows back from the engine 10 when the engine is stopped. The cross-sectional areas of the air cleaner 30 and the evaporated fuel adsorbing mechanism 20 are set to be larger than the cross-sectional area of the intake passage 50. The air cleaner 30 and the evaporated fuel adsorbing mechanism 20 serve as a surge tank to smooth the pulsation of the air that passes through the intake passage 50.

A throttle body 70 is provided in a portion of the intake passage 50 downstream of the evaporated fuel adsorbing mechanism 20 and upstream of the intake port 13*a*. A throttle valve 71 is disposed in the throttle body 70. The amount of air introduced to the engine 10 is adjusted by adjusting the opening degree of the throttle valve 71. Further, an airflow meter 40 is provided in the portion of the intake passage 50 downstream of the evaporated fuel adsorbing mechanism 20 and upstream of the throttle body 70. The airflow meter 40 measures the amount of air taken into the engine 10.

An injector 18 that injects fuel to each of the combustion chambers 15 is provided in the vicinity of the intake port 13*a* in each cylinder. Fuel is supplied to the injector 18 from a fuel tank (not shown) under a predetermined pressure by a fuel pump (not shown).

Next, the structure of the evaporated fuel adsorbing mechanism 20 will be described in detail with reference to FIG. 2 and FIG. 3, which are enlarged views of the evaporated fuel adsorbing mechanism 20 in FIG. 1. It should be noted that FIG. 2 is a cross-sectional view taken along line 2-2 in FIG. 3, and the intake air flows from the left side to the right side in FIG. 2 when the engine is operated. FIG. 3 is a cross-sectional view taken along line 3-3 in FIG. 2.

Figure 2:
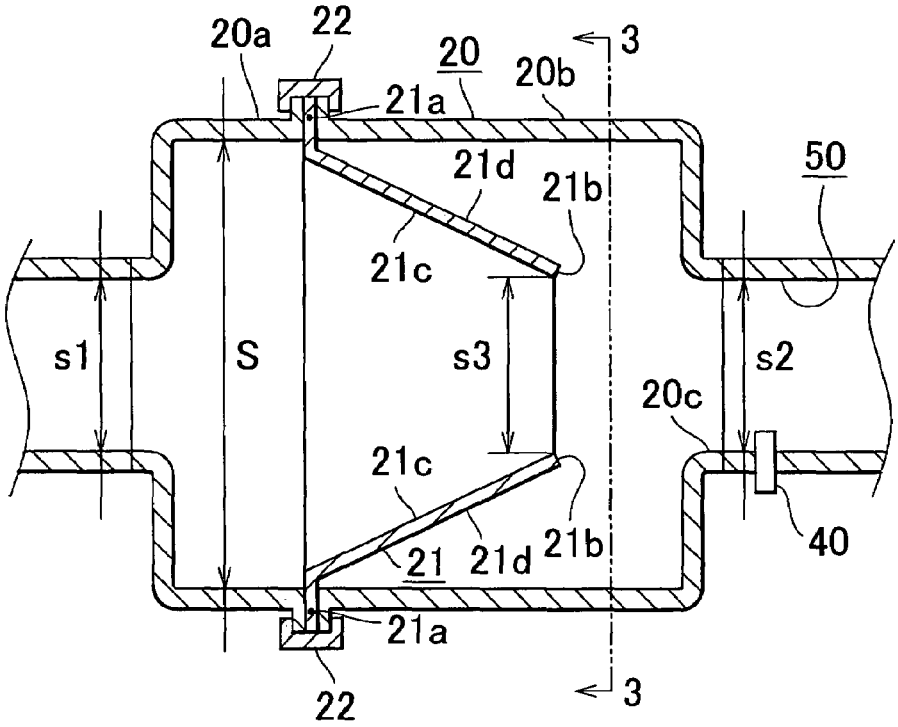
FIG. 2 is an enlarged cross-sectional view of an evaporated fuel adsorbing mechanism according to the first embodiment shown in FIG 1, taken along line 2-2 in FIG. 3.
Figure 3:
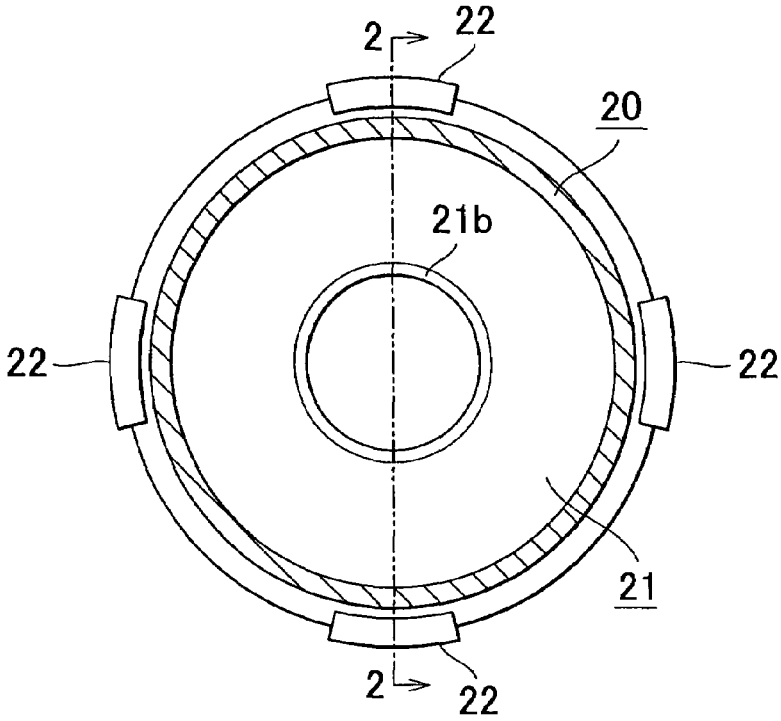
FIG. 3 is a cross-sectional view taken along line 3-3 in FIG. 2.

As shown in FIG. 2, a housing 20*a* and a housing 20*b* constitute the upstream side and the downstream side of the evaporated fuel adsorbing mechanism 20, respectively. A flange 21*a*, is sandwiched between the housings 20*a* and 20*b*. The evaporated fuel adsorbing mechanism 20 is formed by integrally connecting the housings 20*a* and 20*b*, and the flange 21*a* using clamps 22 at several positions (four positions in the case of FIG. 3) along the outer periphery of the evaporated fuel adsorbing mechanism 20, as shown in FIG. 3. The inner diameter of the housings 20*a* and 20*b* is larger than the inner diameter of the portion of the intake passage 50 upstream of the housing 20*a* and the inner diameter of the portion of the intake passage 50 downstream of the housing 20*b*. Accordingly, the cross-sectional area S of the housings 20*a* and 20*b* is set to be larger than the cross-sectional area s1 of the portion of the intake passage 50 upstream of the housing 20*a* and the cross-sectional area s2 of the portion of the intake passage 50 downstream of the housing 20*b*. The flange 21*a* is regarded as the connecting portion of the invention.

The adsorbing member 21 has a cylindrical shape. The diameter of the adsorbing member 21 gradually decreases from the upstream side toward the downstream side in the direction in which intake air flows (hereinafter, referred to as "intake-air flow direction"), that is, from the left side to the right side in FIG. 2. The adsorbing member 21 includes the flange 21*a* provided at an end portion on the upstream side in the intake-air flow direction. By sandwiching the flange 21*a* between the housings 20*a* and 20*b*, the adsorbing member 21 is fixed such that the adsorbing member 21 protrudes inside the evaporated fuel adsorbing mechanism 20. Thus, the adsorbing member 21 is connected to the entire periphery of the inner peripheral surfaces of the housings 20*a* and 20*b*. To direct the intake air toward an opening 20*c* connected to the portion of the intake passage 50 downstream of the housing 20*b*, an end 21*b* of the adsorbing member 21 is disposed downstream of the flange 21*a* in the intake-air flow direction, and a surface 21*c* that faces toward the upstream side in the intake-air flow direction (hereinafter referred to as "upstream-side surface 21*c*") and a surface 21*d* that faces toward the downstream side in the intake-air flow direction (hereinafter referred to as "downstream-side surface 21*d*") are both inclined from a plane perpendicular to the intake-air flow direction, toward the downstream side in the intake-air flow direction. Furthermore, the cross-sectional area s3 of the flow passage at the end 21*b* of the adsorbing member 21 is set to be equal to the cross-sectional area s2 of the opening 20*c* connected to the portion of the intake passage 50 downstream of the housing 20*b*. The end 21*b* is regarded as the end portion of the invention.

In the first embodiment, the adsorbing member 21 is formed of a material that is not air-permeable. However, because the flow passage has the cross-sectional area s3 at the end 21*b*, intake air is allowed to flow through the flow passage. The absorbing member 21 need not be connected to the entire periphery of the housings 20*a* and 20*b*. The absorbing member 21 may be connected to a part of the periphery of the housings 20*a* and 20*b*.

As described so far, the evaporated fuel adsorbing mechanism 20 according to the first embodiment of the invention provides the following effects.

(1) The adsorbing member 21 has the portion connected to the inner peripheral surfaces of the housing 20*a* and 20*b* (hereinafter, referred to as "connecting portion"); and the end 21*b* that is away from the inner surface of the housing 20*b*. The end 21*b* of the adsorbing member 21 is disposed downstream of connecting portion in the intake-air flow direction. The upstream-side surface 21*c* and the downstream-side surface 21*d* extend from the connecting portion to the end 21*b*. The upstream-side surface 21*c* and the downstream-side surface 21*d* are both inclined from a plane perpendicular to the intake-air flow direction, toward the downstream side in the intake-air flow direction. Accordingly, when the engine is operated, intake air smoothly flows along the upstream-side surface 21*c* of the adsorbing member 21, from the connecting portion to the end 21*b*.

The downstream-side surface 21*d* of the adsorbing member 21 extends from the connecting portion to the end 21*b*. The downstream-side surface 21*d* is inclined from a plane perpendicular to the intake-air flow direction, toward the downstream side in the intake-air flow direction. Therefore, the evaporated fuel, which flows from the downstream side to the upstream side in the intake-air flow direction when the engine is stopped, flows along the downstream-side surface 21*d* of the adsorbing member 21, from the end 21*b* to the connecting portion, and the evaporated fuel is retained in an area near and downstream of the connecting portion in the intake-air flow direction. Further, it is possible to reduce the possibility that the evaporated fuel, which flows along the inner peripheral surface of the housing 20*b* toward the upstream side in the intake-air flow direction, enters the adsorbing member 21 through the end 21*b*, because the downstream-side surface 21*d* of the adsorbing member 21 is inclined in the above-described manner. As a result, it is possible to significantly suppress the increase in the pressure loss during engine operation, while appropriately suppressing the discharge of the evaporated fuel to the atmosphere.

(2) The adsorbing member 21 is provided inside the housings 20*a* and 20*b*, and the cross-sectional area S of the housings 20*a* and 20*b* is set to be larger than the cross-sectional area s1 of the portion of the intake passage 50 upstream of the housing 20*a* and the cross-sectional area s2 of the portion of the intake passage 50 downstream of the housing 20*b*. Thus, the provision of the adsorbing member 21 in the intake passage 50 further suppresses the increase in the pressure loss.

(3) The cross-sectional area s3 of the flow passage at the end 21*b* of the adsorbing member 21 is set to be equal to the cross-sectional area s2 of the opening 20*c* connected to the portion of the intake passage 50 downstream of the housing 20*b*. Thus, it is possible to secure the same cross-sectional area of the flow passage as in the case where the adsorbing member 21 is not provided in the intake passage 50.

(4) The upstream-side surface 21*c* of the adsorbing member 21 directs the intake air toward the opening 20*c* connected to the portion of the intake passage 50 downstream of the housing 20*b*. Accordingly, it is possible to smoothly direct the intake air to the downstream side when the engine is operated.

(5) The connecting portion of the adsorbing member 21 may be formed in an annular shape along the entire periphery of the adsorbing member. In this case, the evaporated fuel that flows along the downstream-side surface 21*d* of the adsorbing member 21, from the end 21*b* to the connecting portion, and the evaporated fuel that flows along the inner surface of the housing 20*b* toward the upstream side in the intake-air flow direction, can be reliably retained in the area downstream of the annular connecting portion in the intake-air flow direction.

(6) Because the evaporated fuel adsorbing mechanism 20 is disposed upstream of the airflow meter 40 in the intake passage 50, the airflow meter 40 detects the flow rate of air that has been rectified when passing through the evaporated fuel adsorbing mechanism 20. Therefore, variation in the detection values is suppressed, leading to improvement in accuracy of the air/fuel ratio control.

This effect becomes more significant as the distance between the airflow meter 40 and the evaporated fuel adsorbing mechanism 20 decreases. Accordingly, it is desirable that the evaporated fuel adsorbing mechanism 20 be disposed as near as possible to the position of the airflow meter 40.

Next, a second embodiment of the invention will be described in which the evaporated fuel adsorbing mechanism according to the invention is embodied as an air cleaner. The basic structure of the evaporated fuel adsorbing mechanism in the second embodiment is the same as that in the first embodiment. Accordingly, the second embodiment will be hereinafter described with a focus on the difference from the first embodiment, with reference to FIG. 4. Note that FIG. 4 is a cross-sectional view of the air cleaner, and intake air flows from the left side to the right side in the drawing during engine operation.

Figure 4:
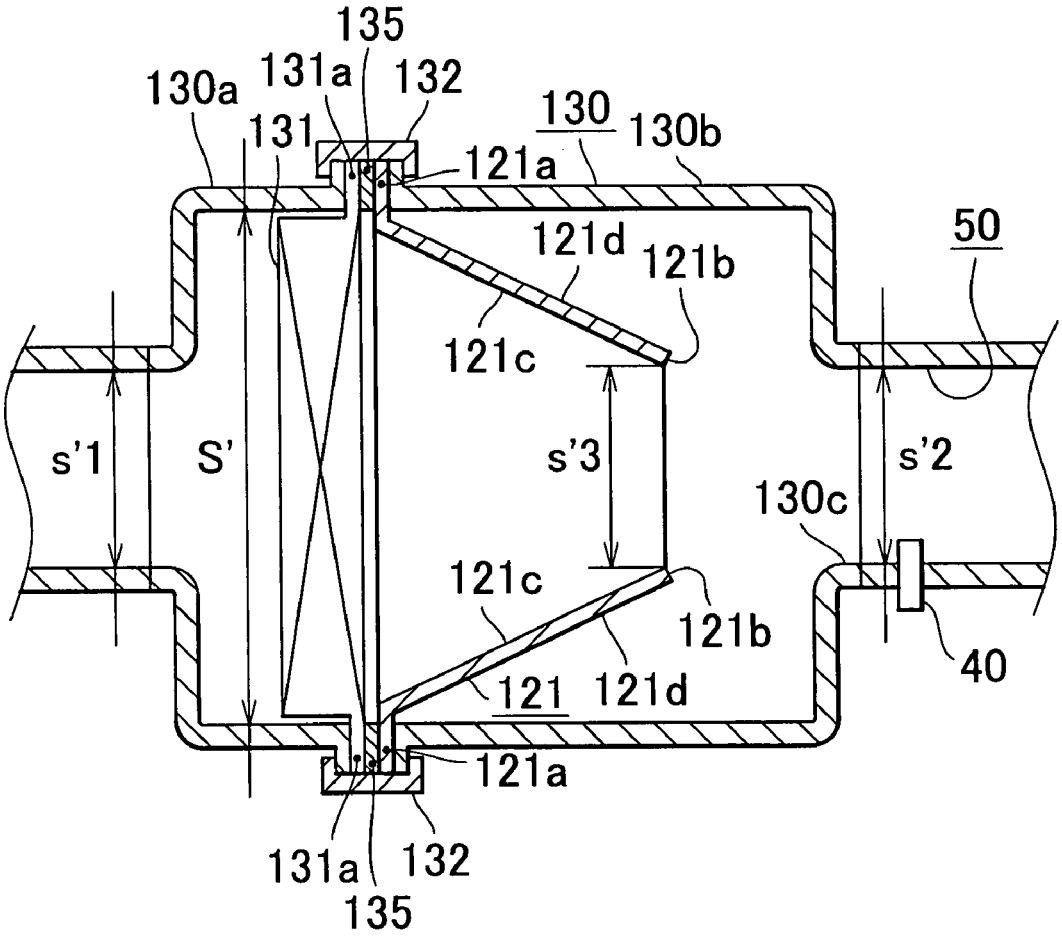
FIG. 4 is a cross-sectional view of an air cleaner according to a second embodiment of the invention.

As shown in FIG. 4, an air cleaner 130 has a cylindrical outer shape. A housing 130*a* and a housing 130*b* constitute the upstream side and the downstream side of the air cleaner 130, respectively. A flange 131*a* of a filter 131 and a flange 121*a* of an adsorbing member 121 are sandwiched between the housings 130*a* and 130*b*. Further, a ring-shaped spacer 135 is interposed between the flange 131*a* of the filter 131 and the flange 121*a* of the adsorbing member 121 to suppress the penetration of fuel adsorbed by the adsorbing member 121 into the filter 131. The housings 130*a*, 130*b*, the flanges 131*a*, 121*a*, and the spacer 135 are all integrally connected by clamps 132. The flange 121*a* is regarded as the connecting portion of the invention.

The inner diameter of the air cleaner 130 is larger than the inner diameters of the portions of the intake passage 50 upstream and downstream of the air cleaner 130. Accordingly, the cross-sectional area S' of the air cleaner 130 is set to be larger than the cross-sectional area s'1 of the portion of the intake passage 50 upstream of the air cleaner 130, and the cross-sectional area s'2 of the portion of the intake passage 50 downstream of the air cleaner 130. Further, to direct the intake air to an opening 130*c* connected to the portion of the intake passage 50 downstream of the air cleaner 130, an end 121*b* of the adsorbing member 121 is disposed downstream of the flange 121*a* in the intake-air flow direction, and a surface

121*c* that faces toward the upstream side in the intake-air flow direction (hereinafter referred to as "upstream-side surface 121*c*"), and a surface 121*d* that faces toward the downstream side in the intake-air flow direction (hereinafter referred to as "downstream-side surface 121*d*") are both inclined from a plane perpendicular to the intake-air flow direction, toward the downstream side in the intake-air flow direction. Furthermore, the cross-sectional area s'3 of the flow passage at the end 121*b* of the adsorbing member 121 is set to be equal to the cross-sectional area s'2 of the opening 130*c* connected to the portion of the intake passage 50 downstream of the air cleaner 130. The end 121*b* is regarded as the end portion of the invention.

As described so far, the air cleaner 130 according to the second embodiment of the invention provides the following effects, in addition to the effects obtained in the first embodiment.

(7) The housings 130*a* and 130*b* of the air cleaner 130 are used as an enlarged portion having a cross-sectional area larger than the cross-sectional areas of the portions of the intake passage 50 upstream and downstream of the air cleaner 130. Therefore, there is no need to separately provide an enlarged portion in the intake passage 50. Further, the upstream-side surface 121*c* of the adsorbing member 121 directs the intake air toward the opening 130*c* connected to the portion of the intake passage 50 downstream of the air cleaner 130. Accordingly, when the engine is operated, it is possible to smoothly direct the intake air to the portion of the intake passage 50 downstream of the air cleaner 130.

Next, with reference to FIG. 5A and FIG. 5B, a third embodiment of the invention will be described, which is a modified example of the first embodiment. The basic structure of an evaporated fuel adsorbing mechanism in the third embodiment is the same as that in the first embodiment, except that the adsorbing member has ridges.

Figure 5B:
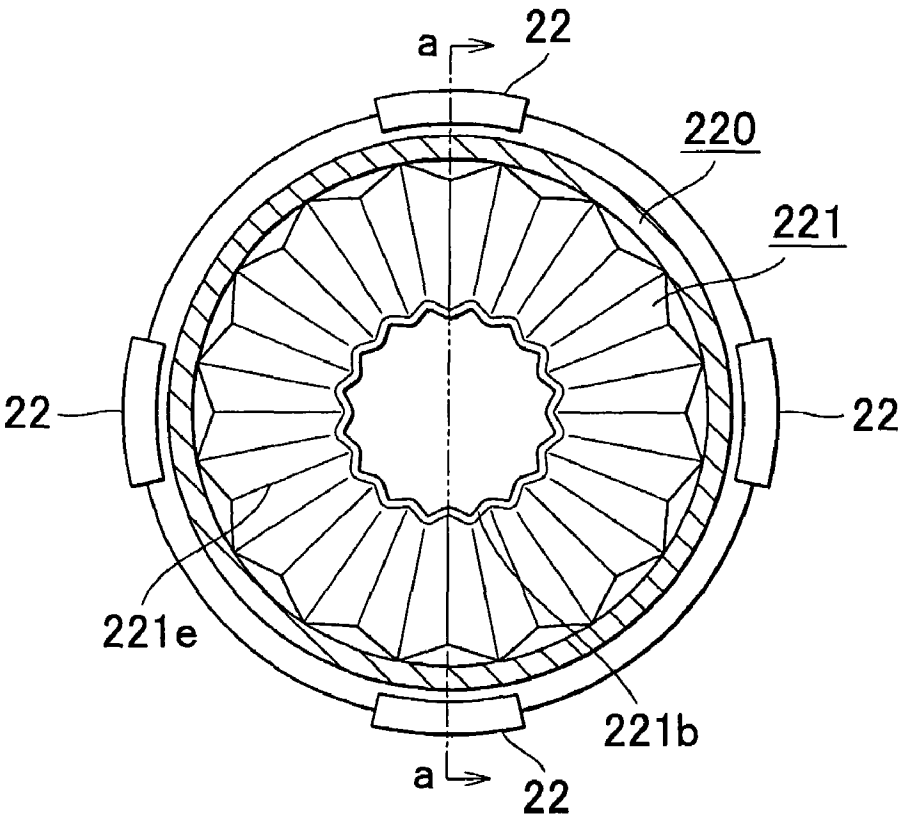
FIG. 5B is a cross-sectional view taken along line b-b in FIG. 5A.
Figure 5A:
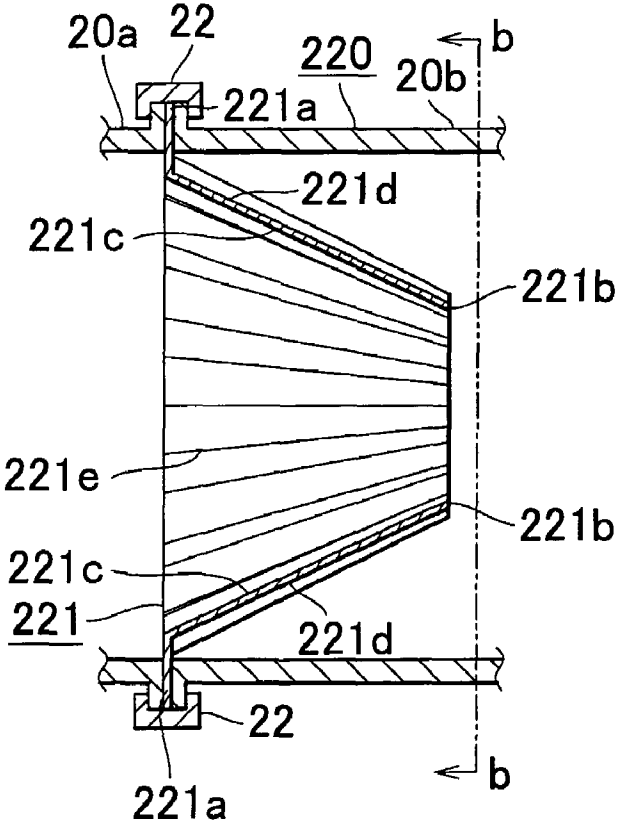
FIG. 5A is a cross-sectional view of an evaporated fuel adsorbing mechanism according to a third embodiment of the invention, taken along line a-a in FIG. 5B.

With reference to FIG. 5A and FIG. 5B, the third embodiment will be hereinafter described with a focus on the difference from the first embodiment. FIG. 5A is a cross-sectional view taken along line a-a in FIG. 5B, and intake air flows from the left side to the right side in the drawing during engine operation. FIG. 5B is a cross-sectional view taken along line b-b in FIG. 5A.

In the third embodiment, by sandwiching a flange 221*a* of an adsorbing member 221 between the housings 20*a* and 20*b*, the adsorbing member 221 is fixed such that the adsorbing member 221 protrudes inside an evaporated fuel adsorbing mechanism 220, as in the first embodiment. A plurality of ridges is provided on the entire peripheries of a surface 221*c* and a surface 221*d* of the adsorbing member 221 to increase the surface area of the adsorbing member 221. The surface 221*c* faces toward the upstream side in the intake-air flow direction (hereinafter referred to as "upstream-side surface 221*c*"). The surface 221*d* faces toward the downstream side in the intake-air flow direction (hereinafter referred to as "downstream-side surface 221*d*"). The ridge lines 221*e* extend in the intake-air flow direction. The flange 221*a* is regarded as the connecting portion of the invention.

Further, as in the first embodiment, to direct the intake air toward the opening connected to the portion of the intake passage downstream of the housing 20*b*, an end 221*b* of the adsorbing member 221 is disposed downstream of the flange 221*a* in the intake-air flow direction, and the upstream-side surface 221*c* and the downstream-side surface 221*d* are both inclined from a plane perpendicular to the intake-air flow direction, toward the downstream side in the intake-air flow direction. Further, the cross-sectional area of the flow passage at the end 221*b* of the adsorbing member 221 is set to be equal to the cross-sectional area of the opening connected to the portion of the intake passage downstream of the housing 20*b*. The end 221*b* is regarded as the end portion of the invention.

As described so far, the evaporated fuel adsorbing mechanism 220 according to the third embodiment of the invention provides the following effects, in addition to the effects obtained in the first embodiment.

(8) The ridges are formed on the upstream-side surface 221*c* of the adsorbing member 221 so as to increase the surface area of the adsorbing member 221, and the ridge lines of the ridges extend in the intake-air flow direction. Accordingly, it is possible to suppress the increase in the pressure loss. Moreover, the ridges formed on the downstream-side surface 221*d* of the adsorbing member 221 do not interfere with the flow of the intake air. Accordingly, it is possible to further increase the capability of adsorbing the evaporated fuel without increasing pressure loss.

It should be noted that the evaporated fuel adsorbing mechanism according to the invention is not limited to the above-described embodiments, and various modifications may be made to the above-described embodiments. For example, the evaporated fuel adsorbing mechanism according to the invention may be realized in the following embodiments.

The invention is not limited to the structure in which the adsorbing member is fixed by sandwiching the flange of the adsorbing member between the housings. The adsorbing member may be fixed to the inner surface of the housing using an adhesive or the like.

The adsorbing member in each of the above-described embodiments may be formed using an air-permeable filter that includes, for example, activated carbon. It is possible to further suppress the increase in the pressure loss during engine operation by forming the adsorbing member using such an air-permeable filter.

The flange formed along the entire periphery of the adsorbing member, and the adsorbing member is fixed by sandwiching the flange between the housings. However, such a connecting portion need not be necessarily formed along the entire periphery of the adsorbing member. For example, only one of the lower end, the upper end, or a part of the adsorbing member may be connected to the housings.

In each of the above-described embodiments, the adsorbing member is formed of a single annular member. However, a plurality of adsorbing members may be combined to form a structure that directs the intake air to the downstream side. Further, the adsorbing member need not necessarily be formed along the entire inner periphery. For example, the adsorbing member may be formed along the lower half inner periphery of the intake passage in a vertical direction.

In each of the above-described embodiments, the adsorbing member is formed of a thin flat material having the upstream-side surface and the downstream-side surface that are parallel to each other. However, the upstream-side surface and the downstream-side surface need not be necessarily parallel to each other, as long as the end portion of the adsorbing member is disposed downstream of the connecting portion in the intake-air flow direction and the upstream-side surface and the downstream-side surface are both inclined from a plane perpendicular to the intake-air flow direction, toward the downstream side in the intake-air flow direction.

In each of the above-described embodiments, the portion where the flange of the adsorbing member is connected to the housings is perpendicular to the intake-air flow direction. However, the portion where the flange is connected to the housings may be inclined from a plane perpendicular to the intake-air flow direction, toward the downstream side in the intake-air flow direction.

The enlarged portion is formed in the intake passage 50 to increase the flow cross-sectional area, and the adsorbing member is provided in the enlarged portion. However, the evaporated fuel adsorbing mechanism according to the invention may be provided in the intake passage without forming the enlarged portion.

The cross-sectional area of the flow passage at the end portion of the adsorbing member may be smaller than that of the opening that connects the enlarged portion and the portion of the intake passage downstream of the enlarged portion. In this case, although the pressure loss is large during engine operation, it is possible to effectively suppress the backflow of the evaporated fuel.

The cross-sectional area of the flow passage at the end portion of the adsorbing member may be larger than that of the opening that connects the enlarged portion and the portion of the intake passage downstream side of the enlarged portion. In this case, although the backflow of the evaporated fuel is suppressed less effectively, it is possible to further reduce pressure loss during engine operation.

In each of the above-described embodiments, the upstream-side surface of the adsorbing member is formed to direct the intake air toward the opening of the housing on the downstream side. However, with a structure where the intake air is not actively directed toward the opening of the housing on the downstream side, it is possible to suppress the backflow of the evaporated fuel.

The position where the evaporated fuel adsorbing mechanism is installed is not limited to the position upstream of the throttle body 70 in the intake-air flow direction. The evaporated fuel adsorbing mechanism may be installed downstream of the throttle body 70 in the intake-air flow direction.

In each of the above-described embodiments, the evaporated fuel adsorbing mechanism has a cylindrical outer shape. However, the evaporated fuel adsorbing mechanism may have other outer shapes, such as a rectangular parallelepiped shape. In this case, the shape of the adsorbing member may be changed according to the outer shape of the mechanism.

What is claimed is:

1. An evaporated fuel adsorbing mechanism for an internal combustion engine, comprising:

an adsorbing member that is provided in an intake passage of the internal combustion engine to adsorb evaporated fuel that flows back through the intake passage when the internal combustion engine is stopped, said adsorbing member being provided in a housing located between an upstream intake air filter and a downstream intake passage of the internal combustion engine, said adsorbing member having an outlet facing an inlet of said downstream intake passage;

wherein the adsorbing member includes a pair of inclined side walls extending from an opening to the outlet, the outlet having an area that is substantially equal to an area of the inlet of the downstream intake passage; and wherein a slope of the inclined side walls and the area of the outlet are configured to suppress an increase in pressure loss during operation of the internal combustion engine.

2. The evaporated fuel adsorbing mechanism according to claim 1, wherein the adsorbing member is provided in an enlarged portion of the intake passage, which has a cross-sectional area that is larger than cross-sectional areas of portions of the intake passage upstream and downstream of the enlarged portion.

3. The evaporated fuel adsorbing mechanism according to claim 2, wherein:

the adsorbing member has a cylindrical shape; and a diameter of the adsorbing member decreases from the upstream side to the downstream side in the intake-air flow direction.

4. The evaporated fuel adsorbing mechanism according to claim 2, wherein a cross-sectional area of a flow passage at an end portion of the adsorbing member is set to be equal to a cross-sectional area of an opening that connects the enlarged portion and the portion of the intake passage downstream of the enlarged portion.

5. The evaporated fuel adsorbing mechanism according to claim 2, wherein the adsorbing member directs intake air toward an opening that connects the enlarged portion and the portion of the intake passage downstream of the enlarged portion.

6. The evaporated fuel adsorbing mechanism according to claim 1, wherein a connecting portion of the adsorbing member is formed in an annular shape along an entire periphery of the inner peripheral surface of the intake passage.

7. The evaporated fuel adsorbing mechanism according to claim 1, wherein:

a ridge is formed on each of an upstream-side surface and a downstream-side surface of the adsorbing member; and a ridge line of the ridge extends in the intake-air flow direction.

8. The evaporated fuel adsorbing mechanism according to claim 1, wherein the evaporated fuel adsorbing mechanism is provided upstream of an airflow meter in the intake passage in the intake-air flow direction, and the airflow meter measures an amount of intake air taken into the internal combustion engine.

9. An evaporated fuel adsorbing mechanism for an internal combustion engine, comprising:

an adsorbing member that is provided in a housing of an air cleaner to adsorb evaporated fuel that flows back through an intake passage when the internal combustion engine is stopped, said adsorbing member being provided in a housing located between an upstream intake air filter and a downstream intake passage of the internal combustion engine, said adsorbing member having an outlet facing an inlet of said downstream intake passage;

wherein the adsorbing member includes a connecting portion connected to an inner peripheral surface of the housing; and a pair of inclined side walls extending from an opening to the outlet, the outlet having an area that is substantially equal to an area of the inlet of the downstream intake passage;

wherein a slope of the inclined side walls and the area of the outlet are configured to suppress an increase in pressure loss during operation of the internal combustion engine.

10. The evaporated fuel adsorbing mechanism according to claim 9, wherein the housing of the air cleaner constitutes an enlarged portion of the intake passage, which has a cross-sectional area that is larger than cross-sectional areas of portions of the intake passage upstream and downstream of the enlarged portion.

11. The evaporated fuel adsorbing mechanism according to claim 10, wherein:

the adsorbing member has a cylindrical shape; and a diameter of the adsorbing member decreases from the upstream side to the downstream side in the intake-air flow direction.

12. The evaporated fuel adsorbing mechanism according to claim 10, wherein a cross-sectional area of a flow passage at an end portion of the adsorbing member is set to be equal to a cross-sectional area of an opening that connects the housing and the portion of the intake passage downstream of the housing.

13. The evaporated fuel adsorbing mechanism according to claim 10, wherein the adsorbing member directs intake air toward an opening that connects the housing and the portion of the intake passage downstream of the housing.

14. The evaporated fuel adsorbing mechanism according to claim 9, wherein the connecting portion of the adsorbing member is formed in an annular shape along an entire periphery of the inner peripheral surface of the housing.

15. The evaporated fuel adsorbing mechanism according to claim 9, wherein:

a ridge is formed on each of an upstream-side surface and a downstream-side surface of the adsorbing member; and a ridge line of the ridge extends in the intake-air flow direction.

16. The evaporated fuel adsorbing mechanism according to claim 9, wherein the evaporated fuel adsorbing mechanism is provided upstream of an airflow meter in the intake passage in the intake-air flow direction, and the airflow meter measures an amount of intake air taken into the internal combustion engine.

17. The evaporated fuel adsorbing mechanism according to claim 9, further comprising:

a filter for the air cleaner, which is disposed in the housing of the air cleaner; and a spacer interposed between the filter and the adsorbing member.

* * * * *